US008683694B1

(12) United States Patent
Emanuel

(10) Patent No.: US 8,683,694 B1
(45) Date of Patent: Apr. 1, 2014

(54) METHOD OF FORMING A FRAME ASSEMBLY

(71) Applicant: James Hardie Technology Limited, Dublin (IE)

(72) Inventor: Brian A. Emanuel, Baraboo, WI (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 14/061,955

(22) Filed: Oct. 24, 2013

Related U.S. Application Data

(63) Continuation of application No. 13/655,541, filed on Oct. 19, 2012, now Pat. No. 8,596,017.

(60) Provisional application No. 61/555,384, filed on Nov. 3, 2011, provisional application No. 61/558,919, filed on Nov. 11, 2011.

(51) Int. Cl.
*B21D 51/00* (2006.01)
*E06B 3/16* (2006.01)

(52) U.S. Cl.
USPC ..... 29/897; 52/204.1; 52/204.5; 52/656.9; 52/656.1; 52/656.5

(58) Field of Classification Search
CPC ..... E06B 3/667; E06B 3/30; E06B 3/00; E06B 3/12; E06B 3/16; E06B 3/22; E06B 3/96; E06B 3/9645; E06B 1/702; E06B 1/705; E04B 2/7457
USPC ..... 52/204.1, 204.5, 656.1, 656.4, 656.5, 52/656.7, 656.9; 29/897
See application file for complete search history.

(56) References Cited

U.S. PATENT DOCUMENTS

| | | | | |
|---|---|---|---|---|
| 2,792,918 | A | 5/1957 | Olsen | |
| 3,429,602 | A | 2/1969 | Dirilgen | |
| 3,592,289 | A | 7/1971 | Tacke et al. | |
| 3,782,054 | A * | 1/1974 | Goss, Jr. | 403/295 |
| 3,835,613 | A | 9/1974 | Davies | |
| 4,164,105 | A | 8/1979 | Herbst et al. | |
| 4,624,091 | A | 11/1986 | Biro | |
| 4,831,804 | A | 5/1989 | Sayer | |
| 5,187,886 | A | 2/1993 | Wu et al. | |
| 5,491,940 | A | 2/1996 | Bruchu | |
| 5,603,585 | A | 2/1997 | Bruchu et al. | |

(Continued)

OTHER PUBLICATIONS

"Inline Fiberglass 900 Series Windows Vertical Double Hung Tilt Window Drawings and Photographs", at least as early as Nov. 3, 2010 (2 pages).

(Continued)

*Primary Examiner* — Jeanette E Chapman
*Assistant Examiner* — James Buckle, Jr.
(74) *Attorney, Agent, or Firm* — Boyle Fredrickson, S.C.

(57) ABSTRACT

A frame assembly that includes at least two frame members that are connected to one another. A corner key cavity is formed at the outer sides of adjacent frame members and is shaped to cooperate with a corner key. The corner key cooperates with the corner key cavity to secure adjacent frame members to one another. The corner key cavity is formed at or near the outer perimeter of the joined frame members, and extends across a majority of the depth of the frame members. The frame assembly may include a number of frame members that, when secured to one another, define a window frame assembly.

13 Claims, 8 Drawing Sheets

(56) References Cited

U.S. PATENT DOCUMENTS

| | | | |
|---|---|---|---|
| 5,622,017 | A | 4/1997 | Lynn et al. |
| 5,687,533 | A | 11/1997 | Bruchu |
| 5,806,256 | A | 9/1998 | Byrne |
| 5,837,095 | A | 11/1998 | Bruchu et al. |
| 6,047,514 | A | 4/2000 | Verch |
| 6,067,760 | A | 5/2000 | Nowell |
| 6,073,412 | A | 6/2000 | Verch |
| 6,088,989 | A | 7/2000 | Matsu et al. |
| 6,513,288 | B1 | 2/2003 | MacDonald et al. |
| 6,550,210 | B1 | 4/2003 | Levine et al. |
| 7,150,130 | B2 | 12/2006 | Kobayashi et al. |
| 7,174,691 | B2 | 2/2007 | de Garay Arellano |
| 7,207,636 | B2 | 4/2007 | Livingston et al. |
| 7,677,003 | B2 | 3/2010 | Baughn et al. |
| D618,363 | S | 6/2010 | Card |
| D618,822 | S | 6/2010 | Card |
| 7,806,620 | B1 | 10/2010 | Brochez |
| 8,001,743 | B2 | 8/2011 | Lambertini |
| 8,490,347 | B2 | 7/2013 | Valler et al. |
| 8,511,011 | B2 | 8/2013 | Emanuel |
| 2001/0014250 | A1 | 8/2001 | Plummer et al. |
| 2003/0089054 | A1 | 5/2003 | Hornung |
| 2004/0035082 | A1 | 2/2004 | Hudoba et al. |
| 2004/0211134 | A1 | 10/2004 | Glover et al. |
| 2005/0081981 | A1 | 4/2005 | Heikkila |
| 2005/0210777 | A1 | 9/2005 | Baughn et al. |
| 2006/0010796 | A1 | 1/2006 | Akutsu |
| 2006/0260227 | A1 | 11/2006 | Winfield |
| 2007/0234677 | A1 | 10/2007 | Sironko et al. |
| 2010/0018139 | A1 | 1/2010 | Brunnhofer |
| 2011/0041430 | A1 | 2/2011 | Baughn |
| 2012/0279166 | A1 | 11/2012 | Valler et al. |
| 2013/0111847 | A1 | 5/2013 | Emanuel |

OTHER PUBLICATIONS

"Milgard 3285U Fiberglass Double Hung Replacement Window Assembly Drawings", Feb. 2009 (2 pages).

"Parco Double Hung Window Frame Photograph and Webpage", www.parcowindows.com/double_hung.html, at least as early as Nov. 3, 2010 (2 pages.

"Pella Impervia Double Hung Window Frame Drawings", at least as early as Apr. 30, 2010 (3 pages).

"SureView 3500 Series Brochure for Casement Window", at least as early as Nov. 3, 2010 (2 pages).

"Sureview 6500 Double Hung Window Brochure and Photographs", at least as early as Nov. 3, 2010 (4 pages).

* cited by examiner

METHOD OF FORMING A FRAME ASSEMBLY

CROSS-REFERENCE TO RELATED APPLICATION

This application is a continuation of U.S. application Ser. No. 13/655,541, filed Oct. 19, 2012, which claims priority to U.S. Provisional Patent Application Ser. No. 61/555,384 filed on Nov. 3, 2011 and U.S. Provisional Patent Application Ser. No. 61/558,919 filed on Nov. 11, 2011 both titled "Frame Members, Corner Key and Assembly Method" the disclosures of both of which are expressly incorporated herein by reference.

BACKGROUND OF THE INVENTION

This invention relates generally to structural frame assemblies. More particularly, this invention relates to frame assemblies, commonly used in the manufacture of windows and the like, that are formed from interconnected longitudinal elongate frame members.

Windows and doors are the most common light and passage openings applied in the building trade, home construction, or the like. Commonly, the windows and doors include a frame that is constructed to be secured to the building structure and which defines the operation area associated with the openable and closable opening. As is readily understood, windows are commonly provided in a number of configurations, such as, for example, casement windows, picture windows, and/or double hung windows. Such terms are commonly associated with the operation of the sashes or lights of the window relative to the frame. Likewise, doors can be provided in a number of shapes and configured as right or left hand and in or out swings. Regardless of the operation, doors and windows are commonly provided in a number of shapes and sizes to satisfy consumer demands.

Traditionally, opening frames formed of wood would be individualized to satisfy various product offerings. The corner connections associated with most such frame structures require particular attention to avoid failure of the frame assembly due to the possible concentration of forces at the connection between the elongate members of the frame assembly, particularly in view of the ever-increasing design demands being placed on the architectural rather than structural requirements of windows and doors. Design pressure (DP) is one metric of the strength of a window and is measured in pounds per square foot (psf). Measurement techniques for DP are further described in ASTM E1300, titled "Standard Practice for Determining Load Resistance of Glass in Buildings." Windows must satisfy various requirements associated with their implantation. Accordingly, it is believed room exists for improving the frame coiner assembly and/or method for connecting elongated frame members to provide better window opening strength performance.

Another important consideration of window and door construction includes the thermal performance of the entire product which includes the frame. Windows progressed from single pane, storm windows, and double pane windows in an effort to improve the thermal performance of the window. The U-factor is a term that is used in the industry to quantify heat transfer. The units for U-factor are British thermal unit (Btu) per hour per square foot of area per degree Fahrenheit temperature difference. The computer programs Therm 5 and Window 5 are industry-standard computer tools used to simulate heat flow through the edge of the glass and window frame regions as well as through the center of glass. These programs also sum up the respective contribution of each component to determine the U-factor for the overall window assembly. These computer programs were developed by the Lawrence Berkeley National Laboratory and are well accepted for assessing the thermal performance of both a given window and window frame. Based on the parameters associated with currently available window structures, it is believed that room exists from improving the thermal performance of a window assembly by manipulation of the construction of the window frame, a portion of which is the only structure between inside and outside atmospheres.

Accordingly, there is a need for a more robust window or door frame system that can be quickly and conveniently assembled and can preferably be assembled from pre-manufactured parts that can be individualized during assembly. There is also a distinct need for a window or door frame assembly that provides better insulative performance than those currently available.

SUMMARY OF THE INVENTION

The present invention provides a frame system or assembly that overcomes one or more of the drawbacks discussed above. One aspect of the invention discloses a frame assembly that includes at least two frame members that are connected to one another. A corner key cavity is formed at the intersection of adjacent frame members and is shaped to cooperate with a corner key. The corner key cooperates with the corner key cavity to secure adjacent frame members to one another. The corner key cavity is formed nearer an outer than an inner perimeter defined, in part, by the joined frame members. Preferably, the frame assembly includes a number of frame members that, when secured to one another define a window or door frame assembly.

Another aspect of the invention discloses a frame assembly that includes at least two frame members. Each frame member defines an interior space that is divided into at least three longitudinal cavities. One of the at least three cavities is a corner key cavity. The assembly includes at least one corner key that has a first section and a second section. Each section of the corner key is configured to fit into one end of one of the corner key cavities. When the two frame members are joined using the corner key, such that the at least two frame members define an outer perimeter and an inner perimeter, the corner key cavity is adjacent to the outer perimeter. Such a construction provides a robust structure connection between adjacent frame members.

Another aspect of the invention discloses a frame assembly having at least two frame members. Each frame member includes a lineal member that defines an interior space, a first attachment structure, and forms at least a portion of a corner key cavity. A corner key joins the two frame members and has a first section and a second section that are each configured to fit into a respective corner key cavity of adjacent lineal members. Such a frame assembly provides an insulated frame assembly that includes robust corner connections.

Another aspect of the invention discloses a method of forming a frame assembly. Two elongate frame members are formed with an angle at least one end of each frame member. A corner key cavity is defined at an outer radial side of each frame member. A two-part corner key is provided that cooperates with the corner key cavity of two adjacent frame members. Introducing an adhesive to overlapping areas of the corner key cavity and the two-part corner key permanently secures the adjacent frame members to one another.

Various other features, aspects and advantages of the invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
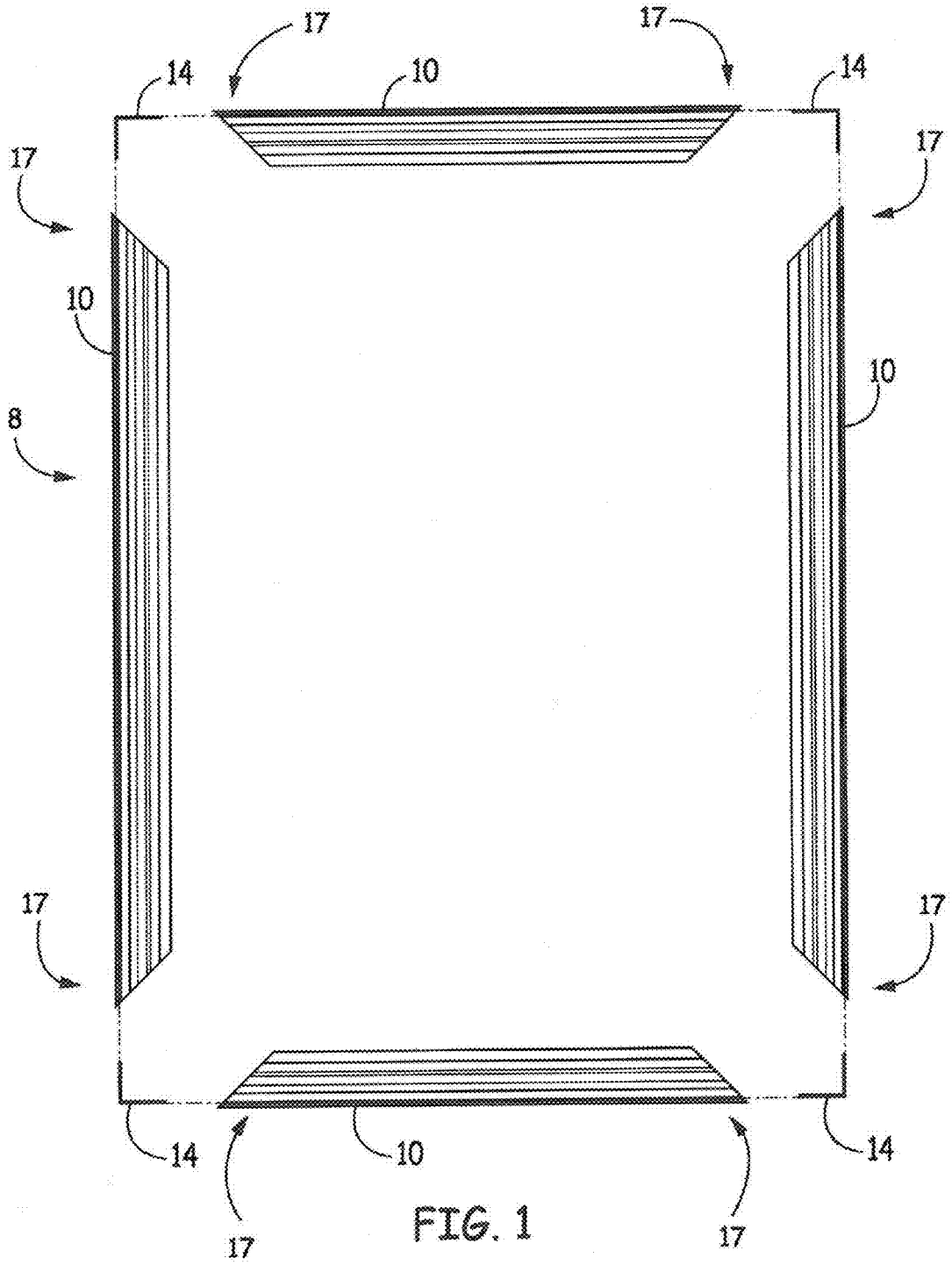
FIG. 1 is a front, partial exploded view of a frame assembly system according to one embodiment of the present invention.

In describing the embodiments of the invention which are illustrated in the drawings, specific terminology is resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

The systems and methods described herein relate generally to joining multiple elongate frame members together using corner keys which fit inside of the ends of the frame members to form a desired frame assembly. More particularly, the present invention is directed to a system and method for forming a frame assembly from longitudinally elongated members that have generally uniform cross-sections such as those commonly formed by pultrusion or extrusion processes. Such systems commonly provide for improved manufacturing efficiencies and better tolerance production of relatively short or limited run product.

Various embodiments of the invention are shown in the figures. For clarity and brevity, like numbers have been used to refer to like parts throughout the several views and embodiments where appropriate.

Figure 2:
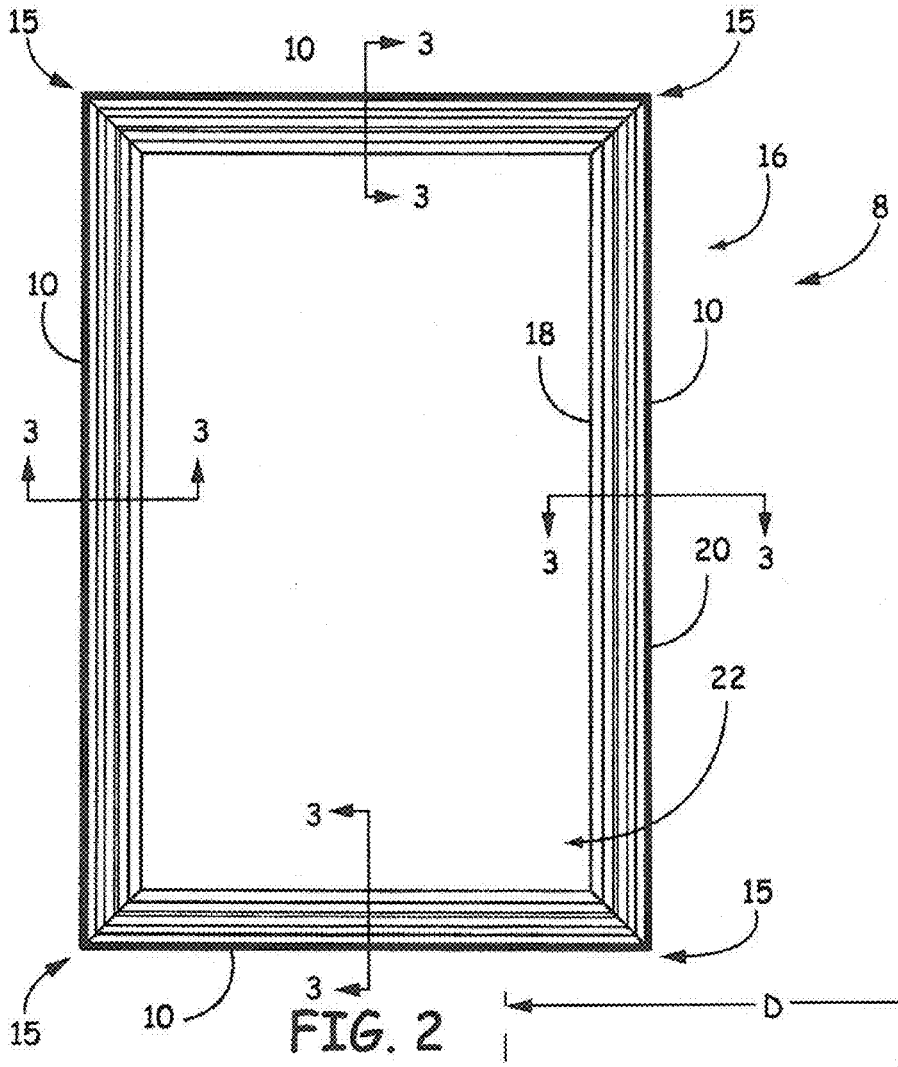
FIG. 2 is a front elevation view of the assembled frame shown in FIG. 1.

FIG. 1 shows an exploded view of a frame system 8 according to one embodiment of the present invention. Frame system 8 includes four frame members 10 and four corner keys 14 that connect respective adjacent frame members 10. FIG. 2 shows an assembled exemplary frame 16 that includes four frame members 10 that are secured at alternate ends of each other to adjacent frame members 10. It should be appreciated that the corner keys 14 are not visible in FIG. 2 because each corner key 14 fits within an interior cavity associated with two adjacent frame members 10 to form a corner joint 15. The assembled frame or frame assembly 16 defines an inner perimeter 18 and an outer perimeter 20 that are generally concentrically oriented relative to one another.

Although inner and outer perimeters 18, 20 are each shown as being continuous and generally rectilinear, respectively, it is appreciated that the present invention is applicable to other shapes and/or other orientations of frame members 10. That is, it is appreciated that frame members 10 can be provided to form a silled or non-silled door opening or the like wherein only one other frame member is joined to two other frame members. That is, the present invention is not intended to be limited by the number or the relative orientation of the various connected frame members. It is possible to apply the disclosed concepts to an assembly that has two frame members, three frame members, five frame members, six frame members, and other numbers of frame members. Where a frame assembly does not form a closed perimeter, such as where there are two frame lineal members at right angles to each other, the inner perimeter can be defined on the side of the frame assembly that has an angle between the frame members of less than 180 degrees. The outer perimeter can be defined on the side of the frame assembly that has an angle between frame members of greater than 180 degrees. Although the frames shown in FIGS. 1-2 form rectangular frames, it is also possible to apply the frame assembly concepts described herein to non-rectangular frames, such as trapezoidal window frames, half-circle window frames, and other window frames, as will be discussed further herein.

An opening 22 defined by the inner perimeter 18 may be configured to mate with a window sash or other selectively operable pane or panel. The sash or the opening 22 may hold a pane of glass, an insulating glass unit, other transparent or translucent material, or a sheet. As shown as a rectangular opening, as alluded to above, it is appreciated that opening 22 can be provided in sizes and shapes other than those shown. It is further appreciated that frame 16 could be configured to receive a fixed panel light and/or moveable light panels such as window panes or sashes that operate as double-hung windows, casement windows, etc.

Referring back to FIGS. 1 and 2, alternate ends or end portions 17 of each frame member 10 are shaped to cooperate with an end of an adjacent frame member 10. Although shown as being oriented at 45 degrees relative to the longitudinal axis of the respective frame members 10, it is appreciated that end portions 17 can be oriented at virtually any angle aside from 180 degrees relative to the longitudinal axis of the respective frame member 10. It is further appreciated that providing the 45 degree configuration of end portions 17 allows frame members 10 to be oriented at orthogonal directions relative to one another wherein opposing frame member are parallel to each other and adjacent frame members 10 are perpendicular to each other. It is further appreciated that in addition to the angle associated with end portions 17, the longitudinal length of each of frame members 10 can be manipulated to achieve the desired orientation and constructions of relative frame members.

As will be discussed further below with respect to FIGS. 8 and 9, corner keys 14 are configured with legs that extend into and fit within the hollow profiles of the frame members 10 to join the ends of the frame members 10 together. Adhesives can then be injected into the corners through specially designed passages to bond the corner keys 14 within the frame members 10 and thereby secure the ends of adjacent frame members 10 permanently together. Preferably, end portions 17 of adjacent frame members 10 are maintained in an abutting arrangement when the discrete members of a respective frame assembly are secured to one another. It is further appreciated that the adhesive associated with securing adjacent frame members 10 and a respective corner key 14 can be provided in number of modalities. In one embodiment, the adhesive is a two-part adhesive. The adhesive is selected to be compatible with the material of the frame member 10 and the material of the corner key 14. One example of a two-part adhesive is NovaGard 900-200 Corner Key Bonding Adhesive, available from NovaGard Solutions, Cleveland, Ohio, which is compatible with the resins in a fiberglass frame member 10 and compatible with a corner key 14 made of acrylonitrile-butadiene-styrene (ABS). In one embodiment, the adhesive, when cured, forms a polymer. In another embodiment, a hot melt adhesive can be injected at the corners. In another embodiment, a thermoplastic adhesive can be injected at the corners. From the disclosure above it should be appreciated that the adhesive associated with securing the respective key 14 and the corresponding frame members 10 can be selected from a number of materials that structurally secure the corresponding structures and do not otherwise degrade or interfere with the structural integrity of the underlying parts. Preferably, only the adhesive permanently secures the corner key 14 and the corresponding frame members 10 such that no other mechanical or other fasteners are required to connect two adjacent frame members 10.

Figure 3:
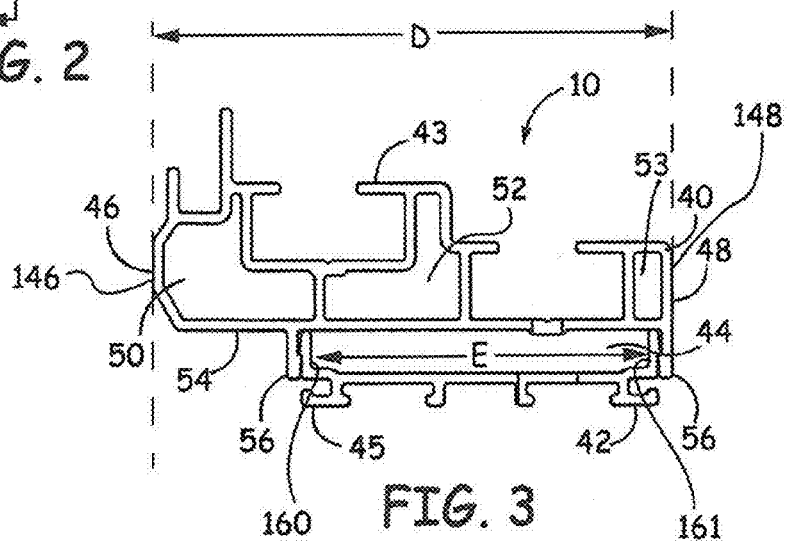
FIG. 3 depicts a cross-sectional view of one of the frame members of the frame assembly taken along any of the lines 3-3 shown in FIG. 2 wherein the frame member includes a lineal member and a cap according to one embodiment of the invention.
Figure 4:
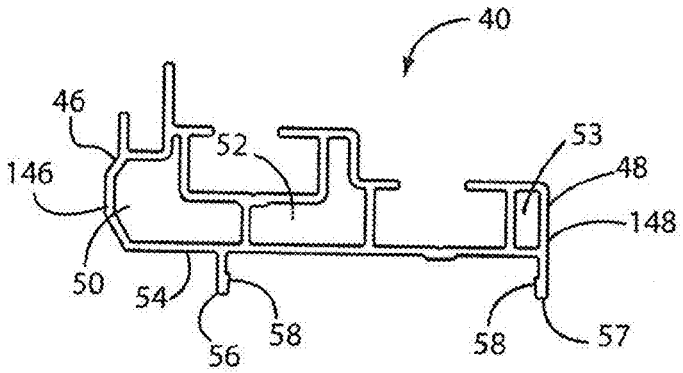
FIG. 4 is a view similar to FIG. 3 and shows the lineal member shown in FIG. 3 with the cap removed therefrom.
Figure 5:
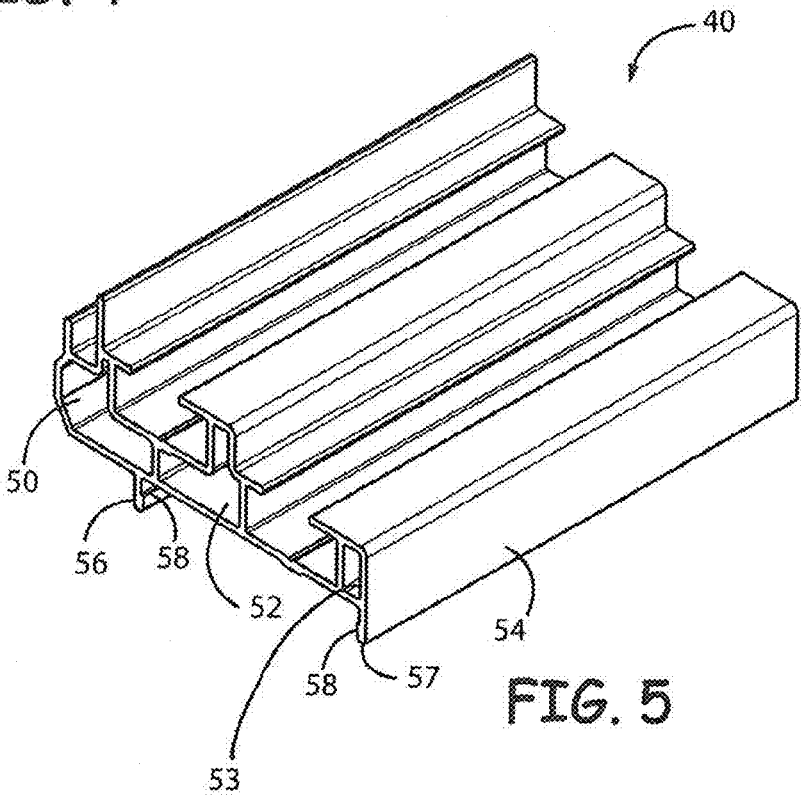
FIG. 5 is a partial perspective view of one of the lineal members shown in FIGS. 1-4.
Figure 6:
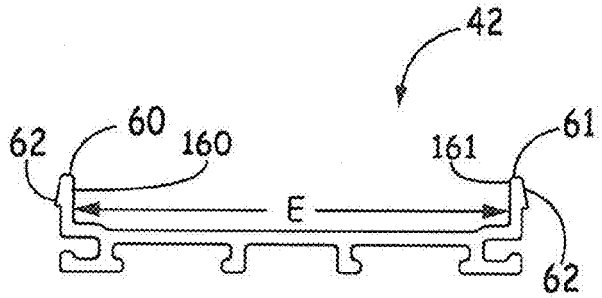
FIG. 6 is a view similar to FIG. 3 and shows the cap shown in FIG. 3 with the lineal member removed therefrom.
Figure 7:
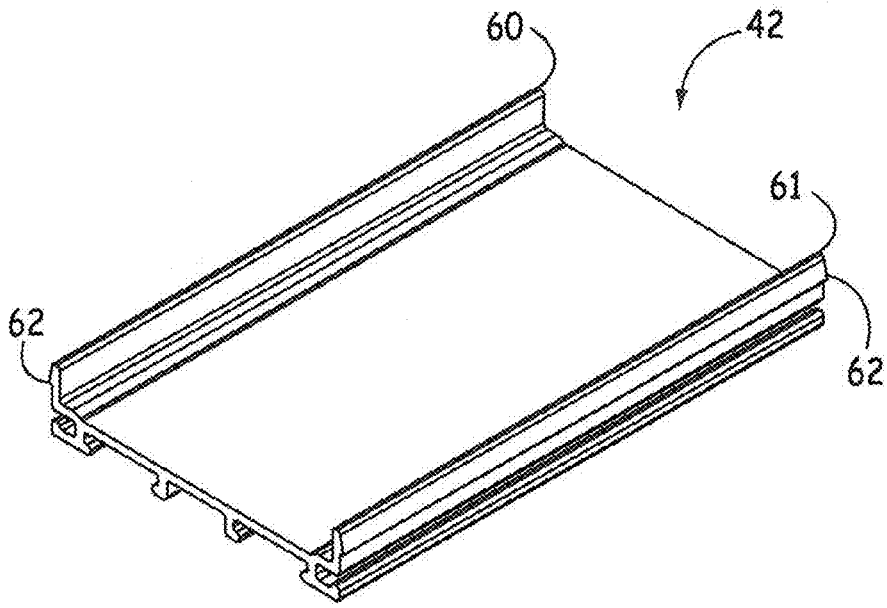
FIG. 7 is a partial perspective view of the cap shown in FIGS. 3 and 6.

Referring to FIG. 3, a cross-sectional view of a frame member 10 is illustrated. Although it is appreciated that the cross-section of each frame member of a frame assembly can be different, preferably, the cross-section of each frame member 10 of a given frame assembly is the same. In this embodiment, each frame member 10 includes two components: a lineal member 40 and a cap 42. The lineal member 40 is illustrated in FIGS. 4 and 5 and the cap 42 is illustrated in FIGS. 6 and 7.

Referring to FIG. 3, cap 42 attaches to the lineal member 40 by a snap-fit attachment. A cavity 44 is formed by the attachment of the cap 42 to the lineal member 40. The cavity 44 is configured to receive one leg or portion of the corner key 14 and is referred to as a corner key cavity 44. An inner first side 43 of the lineal member 40 of each frame member 10 defines the inner perimeter 18 in the assembled frame 16. An opposite outer second side 45 of the lineal member 40 of each frame member 10 defines the outer perimeter 20 in the assembled frame 16 (See FIG. 2). The corner key cavity 44 is adjacent to the outer second side 45 of the frame member 10 that defines the outer perimeter 20 of the frame. Such an orientation increases the strength of the assembled frame compared to other more inward or inboard positions associated with the location of a respective corner key 14.

Preferably, corner key cavity 44 is a longitudinal cavity that extends along the entire length of the frame member 10. The corner key cavity 44 is bounded by a closed perimeter defined by an outward directed surface of lineal member 40 and an inward directed surface of the corresponding cap 42. The bounded configuration of cavity 44 improves the insulation value of the frame assembly 16.

In some embodiments, the corner key cavity 44 extends across most of the depth dimension of the frame member, thereby further increasing the strength of the assembled frame 16. The depth dimension of the frame member 10 is measured from an outside surface 146 of an outer first side 46 to an outside surface 146 of an opposite inner second side 148 of the frame member 10. The depth extension E of the corner key 14 is measured across each of the legs 86, 88 of the corner key 14 as shown in FIG. 8. The corner key 14 fits snugly into the corner key cavity 44. As a result, another way to measure the depth extension E of the corner key 14 is by measuring the inside dimension of the corner key cavity 44. As shown in FIG. 6, the depth extension E of the corner key 14 can also be measured from an inside surface 160 of a first protrusion 60 to an inside surface 161 of a second protrusion 61 associated with cap 42.

Figure 10:
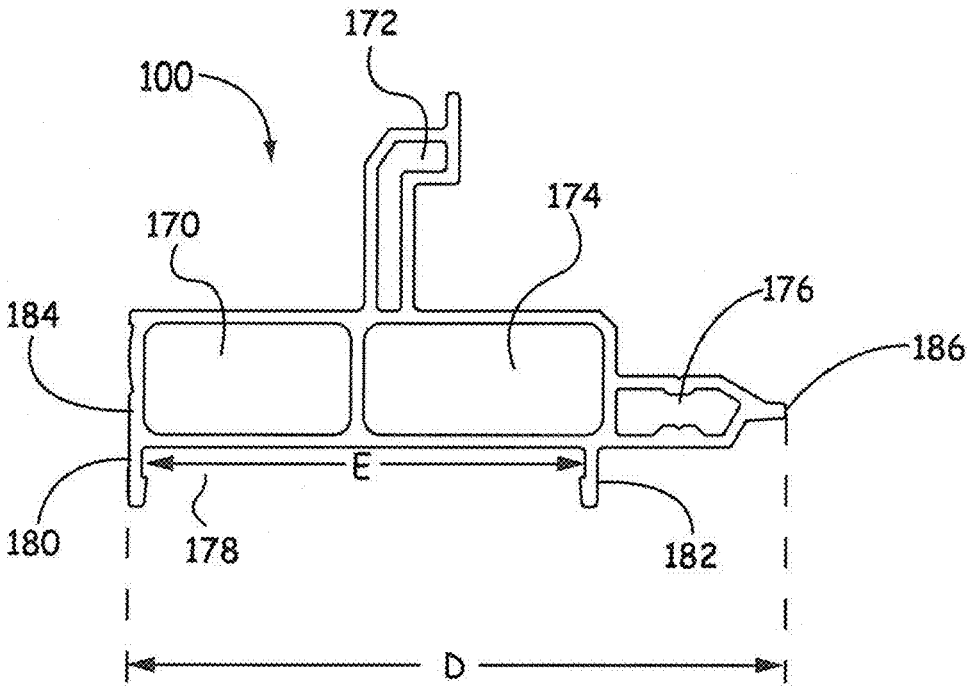
FIG. 10 is a cross-sectional view of a lineal member of a frame assembly according to another embodiment of the invention.
Figure 11:
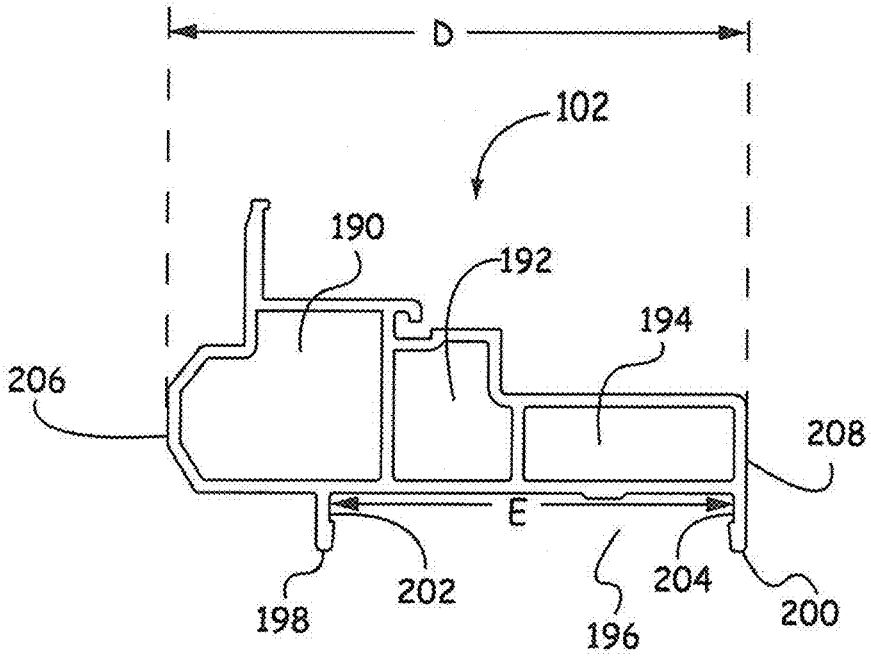
FIG. 11 is a view similar to FIG. 10 of a lineal member according to another embodiment of the invention.
Figure 12:
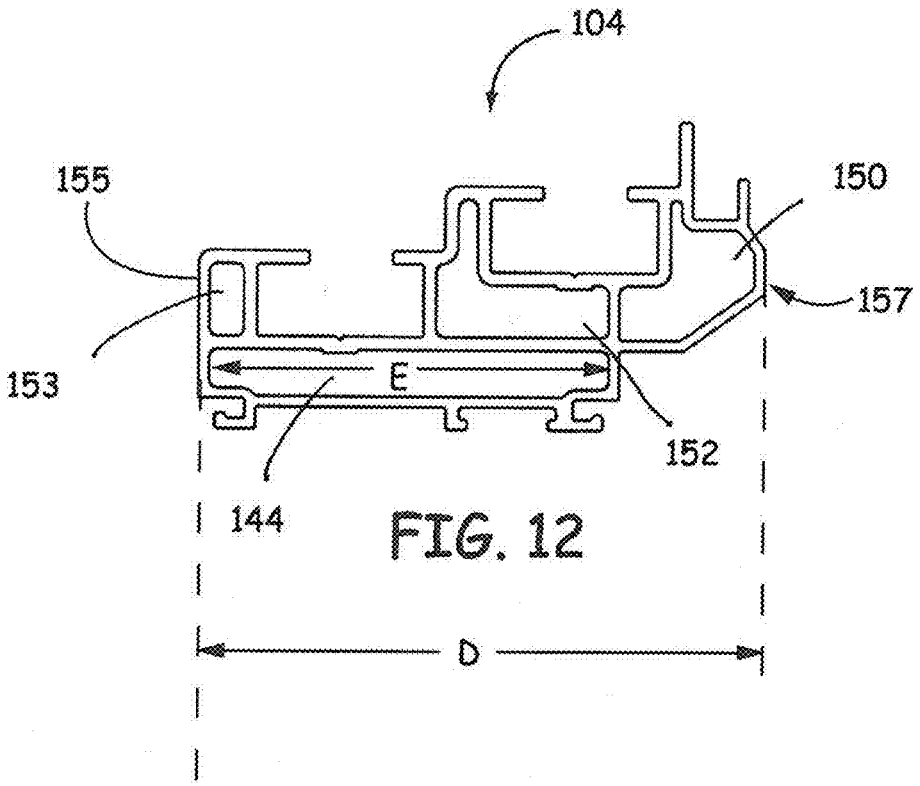
FIG. 12 is a view similar to FIG. 10 of a lineal member according to another embodiment of the invention.

In some embodiments, the corner key cavity extends across at least about 60% of the depth of the frame member. In some embodiments, the corner key cavity extends across at least about 65% of the depth of the frame member. In some embodiments, the corner key cavity extends across at least about 67% of the depth of the frame member. In some embodiments, the corner key cavity extends across at least about 70% of the depth of the frame member. In some embodiments, the corner key cavity extends across at least about 72% of the depth of the frame member. In some embodiments, the corner key cavity extends across at least about 75% of the depth of the frame member. In the embodiment shown in FIGS. 3-5, the corner key extends across about 70% of the depth of the frame member. In the embodiment of FIG. 10, the corner key extends across about 67% of the depth of the frame member. In the embodiment of FIG. 11, the corner key extends across about 75% of the depth of the frame member. In the embodiment of FIG. 12, the corner key extends across about 71% of the depth of the frame member. As used herein, defining the relative dimensions of the depth of the relative frame members as being about a given percentage includes a range of +/−5% relative to the recited percentage.

The assembled frame includes a first face and a second face that are oriented on generally opposite sides of the frame assembly and oriented so as to extend between the inner and outer perimeters 18, 20. That is, one of the faces is facing the viewer in FIG. 2. For example, the first face might be the exterior face of a building's window, while the second face is the interior face of a building's window or that portion of the frame assembly 8 intended to cooperate with the structural framing that defines the opening for receiving the window. Referring to FIG. 3, the first side 46 of the frame member 10 will define part of the first face while the opposite second side 48 of the frame member 10 will define the second face.

In one embodiment, each lineal member 40 defines a first interior cavity 50 and a second interior cavity 52. The inclusion of multiple interior cavities 50, 52 increases the insulating properties of the frame 16. The interior cavities 50, 52 are longitudinal cavities that extend along the length of the frame member 10. In one embodiment, the lineal member 40 further defines a third interior cavity 53. The third interior cavity 53 is adjacent to one side 48, while the first interior cavity is adjacent to the other side 48. The second interior cavity 52 is positioned between the first and third interior cavities 50, 53.

In one embodiment, the lineal member defines at least one interior cavity and an open area for a corner key cavity. In one embodiment, the lineal member defines at least two interior cavities and an open area for a corner key cavity. In one embodiment, the lineal member defines at least three interior cavities and an open area for a corner key cavity. In one embodiment, the lineal member defines at least four interior cavities and an open area for a corner key cavity. It is appreciated that other numbers of interior cavities can be provided.

Referring to FIGS. 3-5, lineal member 40 and cap 42 each include attachment structures that interact with each other to cause a snap-fit attachment of the cap 42 to the lineal member 40. The lineal member 40 shown in FIGS. 4 and 5 includes an exterior surface 54 and first attachment structures or protrusions 56, 57 defined by the exterior surface 54. In one embodiment, protrusions 56, 57 include barbs or nubs 58 located near the ends of the protrusions 56, 57.

Mating attachment structures or protrusions 60, 61 are formed on the cap 42 and are shown in FIGS. 6 and 7, and define barbs or nubs 62 at their respective ends. As shown in FIG. 3, the first and second attachment structures 56, 57, 60, 61 of the lineal member 40 and corresponding cap 42 are configured to lock together when brought into contact with one another. The second attachment structures 60, 61 of the cap 42 fit within the first attachment structures 56, 57 extending from the lineal member 40. The first and second attachment structures are longitudinal features that preferably extend along the entire length of the lineal member 40 and cap 42, respectively, although it is understood that such features may be at spaced apart locations along the length of the respective members. It should be appreciated, that the deflection of protrusions 56, 57 and 60, 61, and the resultant engagement of nubs 58, 62 commonly provides an audible "snap" associated with the desired engagement of the nubs 58, 62 and thereby provides a tactile and/or audible indication of the desired snap-fit interaction between each lineal member 40 and corresponding cap 42. A snap-fit refers to a connection between parts where mating parts exert a cam action, flexing until one part slips past a raised lip on another part. Other types of attachment structures are present in some embodiments and it is appreciated that the attachment parts or one parts may slip past an attachment parts of another part and the attachment parts of either of the lineal part or the cap can be positioned outward or outboard relative to the attachment parts of the other of the lineal part and the cap.

Although shown as a lineal member and a cap that can cooperate with one another in a tool- and fastener-less manner, it is appreciated that lineal member 40 and cap 42 can be provided in other configurations or orientations. That is, the functionality of the attachment structures shown in FIGS. 3-7 being provided as two longitudinal protrusions with barb or nub structures which lock into an attached position with two similar longitudinal protrusions can be provided in a number of ways without departing from the scope of the present invention.

Figure 8:
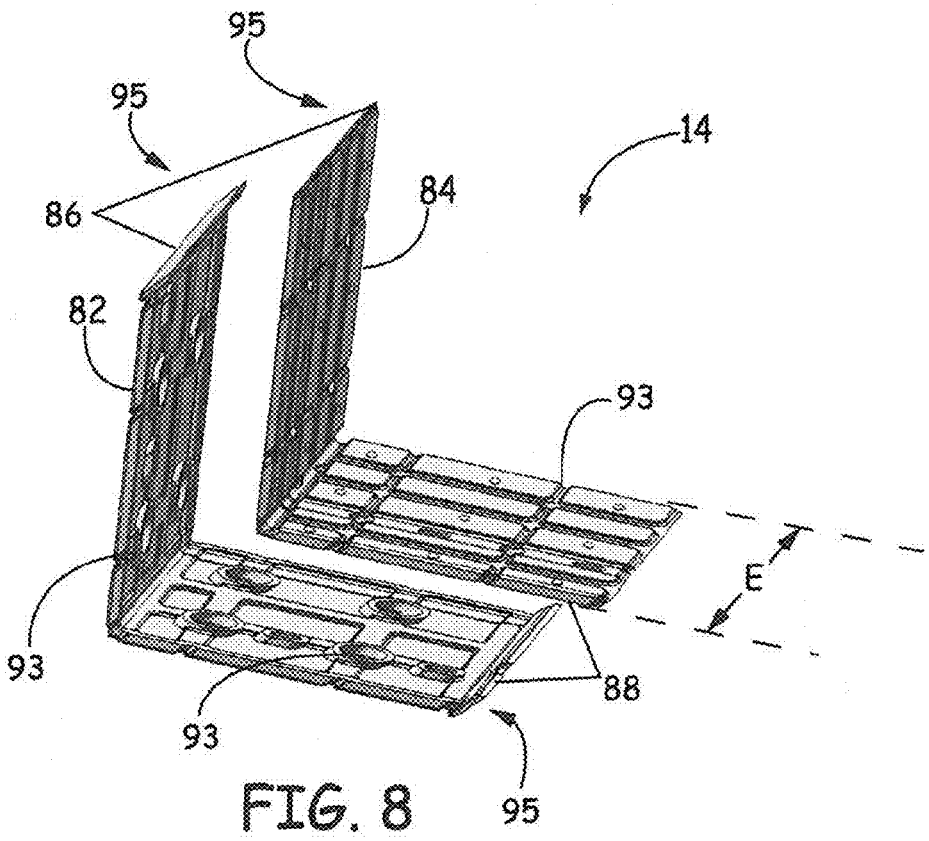
FIG. 8 is a perspective, exploded view of a two-part corner key assembly of the frame assembly shown in FIG. 1.

FIG. 8 is an exploded perspective view of corner key 14 shown in FIG. 1. Corner key 14 includes an outer key or portion 82 that attaches to an inner key or portion 84 using interlocking mechanical structures to form the corner key 14. Providing corner key 14 as two portions improves manufacturing tolerances and variability of the corner key 14 to cooperate with lineal members having differently sized and/or shaped corner key cavities 44. The two-part construction of corner key 14 also allows adhesive to flow between the inner portion 84 and outer portion 82 of each key 14. The corner key 14 shown in FIGS. 8 and 9 has been found to be structurally solid after adhesive has been injected and allowed to cure in each respective corner of a resultant frame assembly 8 so as to provide a frame assembly that is structurally robust.

Figure 9:
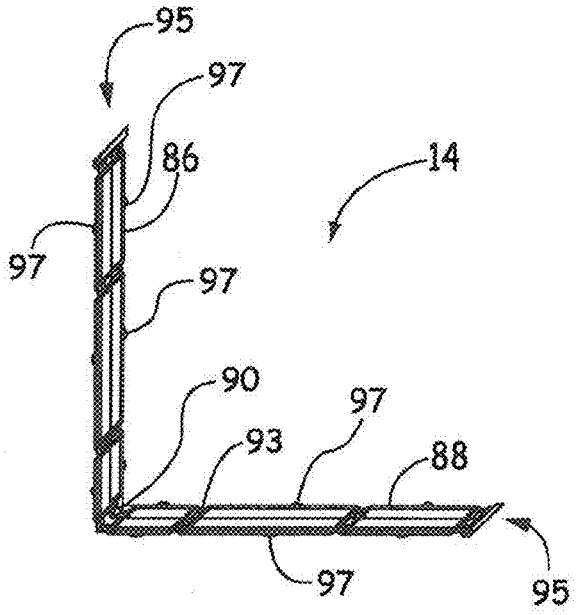
FIG. 9 is a side elevation view of an assembled corner key of a two-part corner key assembly shown in FIG. 8.

Referring to FIG. 9, corner key 14 includes a first leg 86 and a second leg 88 that are oriented at a 90 degree angle relative to one another. It is appreciated that the angle between legs 86, 88 need not be 90 degrees and could be virtually any angle between 0 and 180 degrees as the situation of connecting the lineal members 40 may require. In other embodiments, the angle between the legs can be adjustable. During the assembly of a frame, the first leg 86 is inserted into the end of a corner key cavity 44 associated with a first frame member 10, while the second leg 88 is inserted into the end of a corner key cavity 44 of another or an adjacent frame member 10. The corner key 14 is dimensioned and configured so that it will fit tightly or snugly within the corner key cavities 44. As used herein, tightly and snugly refer to a frictional and/or structural interaction that requires physical manipulation of either of the frame members and/or the corner key to effectuate disengagement between the respective components of the assembled corner. Once positioned relative to one another, the two frame members 10 are joined together by their interaction with corner key 14.

The corner key joint 90 is the portion of the corner key 14 where the two legs 86, 88 or two sections or halves are connected. In one embodiment, joint 90 of the corner key 14 can be flexible so as to act as a living hinge. As a result, the angle between the first and second legs 86, 88 can vary as needed depending on the desired frame shape. Alternatively, it is appreciated that corner key 14 can be provided as a generally rigid structure that maintains its shape and orientation through interaction with lineal member 40 and the formation of assembled frame 16.

Still referring to FIGS. 8 and 9, each corner key 14 includes one or more channels and recesses 93 for routing and retaining adhesive that is injected into the corner area after the corner key 14 is positioned within adjacent frame members 10. The adhesive improves the structural integrity of the joint. In one embodiment, the corner key 14 is made from a non-metallic material and it is appreciated that the corner key 14 can be made from a wide variety of materials including nylon and acrylonitrile-butadiene-styrene (ABS).

As alluded to above, each corner key 14 is configured to fit tightly within a respective pair of adjacent corner key cavities 44. An amount of adhesive is injected into the joint once the corner key 14 is in place, although it is also contemplated that the adhesive may be positioned in the corner key cavities 44 and on the corner key 14 itself prior to assembly. Preferably the amount of adhesive is measured so as to provide total coverage of the interfacing surfaces between corner key 14, the respective portions of the key 14, and the adjoining surfaces of the respective corner key cavity 44. That is, the corner key cavity 44 and the corner key 14 are designed to encourage the adhesive to flow along each leg 86, 88, up against the ramp structures 95 at the ends of the legs, through openings in the corner key 14 and to spaces between inner and outer portions 82, 84. One or more bumps 97 on the sides of the legs 86, 88 are designed to fit snugly into the corner key cavity 44. In one embodiment, adhesive fills all the cracks and crevices in the joint area which is generally defined as the overlapping portions of the frame members and the corner keys. Forming the frame assembly in such a manner allows for the formation of an operable building closure frame assembly that is structurally rigid enough to withstand the operational cooperation with movable parts such as a window pane or sash associated with the frame assembly. The various internal isolated cavities defined by the frame assembly also improves the insulative property of the frame assembly by providing various cavities that are isolated from direct thermal exchange with the volume associated with adjacent cavities.

It is further appreciated that there are a number of ways of forming frame members according to the present invention to form a frame assembly having a desired shape and configuration. In one embodiment, the frame members are cut from lineal stock. In one embodiment, the frame members are formed to the lengths needed for constructing a desired frame assembly. In some embodiments, the frame members define a substantially hollow profile and in yet other embodiments the interior cavity can be divided into multiple cavities that are isolated from one another by interior walls. It is further appreciated that the frame members can be made of pultruded fiberglass material. In another embodiment, the frame members can be made of an extruded thermoplastic composite material. One exemplary thermoplastic composite material includes a generally homogenous material that consists of wood and polymer. It is further appreciated that a product of an extrusion process can be referred to as an extrudate and that an extrudate has a uniform cross-section along its length. The frame members, lineal members and cap can each be formed as extrudates. In one embodiment, the frame members are made of vinyl.

Both pultrusion and extrusion processes form long parts that can have a uniform or constant cross-section along their lengths and can also be referred to as lineals. The lineal may be miter cut or cut in other ways at their ends to allow formation of an attractive joint with another lineal. The lineals may be cut to form the appearance of a mortise and tenon joint, while still using a corner key to join two adjacent frame members. It should be appreciated that FIGS. 3-7 are exemplary of the cross-sections of lineal member 40, cap 42, and frame member 10 according to one embodiment of the invention. FIGS. 10-12 show examples of frame members according to other embodiments of the invention. It should be appreciated that the few cross-section profile examples for window assemblies illustrated herein are merely exemplary of the many different shapes available for fanning frame members according to the present invention.

FIGS. 10 and 11 depict cross-sectional views of different lineal members 100, 102, respectively, for a use in a frame of a casement window and a picture window, respectively. Like the lineal member 40 described with respect to FIGS. 4-5, the lineal members 100, 102 are configured for cooperation with a cap. In one embodiment, each of the lineal members 100, 102 are configured for attachment to the same cap 42 which attaches to lineal member 40 in at least one embodiment. This reduces the number of different parts to be inventoried in a manufacturing environment for frames. It also reduces the tooling expense and complexity of the manufacturing process. In addition, it is possible for a single corner key configuration to be used with multiple lineal members and frame types because the cap forming the corner key cavity is consistent across the various designs. That is, it should be appreciated that corner key 14 and cap 42, shown in FIGS. 7 and 8 respectively, can cooperate with any of lineal members 40, 100, 102 and/or lineal members having cross-sectional shapes other than those shown.

Referring to FIG. 10, lineal member 100 defines four interior cavities 170, 172, 174 and 176, in addition to defining a corner key cavity area 178. The corner key cavity area 178 is defined by two protrusions 180, 182 which serve as attachment structures for attaching to the cap 42. The depth D of the lineal member 100, which will also be the depth D of the resulting frame member including the cap 42, is shown in FIG. 10. The depth D of the lineal member 100 is measured from an outside surface 184 of a first side to an outside surface 186 of an opposite second side of the lineal member 100. The value of distance D is at least about 60% of the value of the distance E.

FIG. 11 shows a lineal member 102 according to another embodiment of the invention. Lineal member 102 has three interior cavities 190, 192, 194 in addition to the corner key cavity area 196. The third interior cavity 194 is adjacent to one side 208, while the first interior cavity 190 is adjacent to the other side 206. The second interior cavity 192 is positioned between the first and third interior cavities 190, 194. The corner key cavity area 196 is defined by two protrusions 198, 200 which serve as attachment structures for attaching to the cap 42. The depth D of the lineal member 102, which is also the depth D of the resulting frame member including the cap 42, is shown in FIG. 11. The depth D of the lineal member 102 is measured from an outside surface 206 of a first side to an outside surface 208 of an opposite second side of the lineal member 102. Although provided in the different shape and configuration than lineal members 40 and 102, it should be readily appreciable from FIG. 11 that the value associated with distance E is more than half of the value associated with distance D. Preferably, distance E is at least about 60% of the value of distance D.

FIG. 12 shows a cross-sectional view a lineal of frame member 104 according to another embodiment of the invention. Like frame member 10, frame member 104 has three interior cavities 150, 152, 153 in addition to the corner key cavity 144. The third interior cavity 153 is adjacent to one side 155 of frame member 104, while the first interior cavity 150 is adjacent to the opposite side 157 of the frame member 104. The second interior cavity 152 is positioned between the first and third interior cavities 150, 153. The corner key cavity 144 is adjacent to the outer side or edge of frame member 104, and therefore adjacent to the perimeter of the frame assembly when the frame members are assembled. A frame assembly is formed by joining two or more of the frame members 104 with a corner key 14. The corner key cavity 144 extends across preferably more than 60% of the depth D of frame member 104, as noted previously. Unlike frame member 10 which includes a separable lineal member and cap to define the corner key cavity, corner key cavity 144 of frame member 104 is integrally formed in the longitudinal shape of the frame member profile. That is, frame member 104 is a unitary member. It is appreciated that frame member 104 can be formed of any pullable or extrudable material and, in one embodiment, frame member 104 is formed by extruding a vinyl frame member 104.

Each of the embodiments disclosed above include elongated frame members that cooperate with corner keys to define a frame assembly having a desired shape and number of sides. In one embodiment, the frame member defines at least one interior cavity and a corner key cavity. In another embodiment, the frame member defines at least two interior cavities and a corner key cavity. In another embodiment, the frame member defines at least three interior cavities and a corner key cavity. Individual features or groups of features described herein with respect to the frame members or lineal members can also be combined with the construction of frame member 104. The various cavities and corner key cavity and corner key constructions disclosed herein provide window and door frame assemblies that exceed the expectations of thermal and structural performance of the result frame assemblies.

The thermal performance of a window can be improved by using a number of the frame assemblies disclosed herein. For instance, the performance of a window constructed in accordance with that which is shown in FIGS. 1-3 was assessed using the Therm 5 and Window 5 programs developed by the Lawrence Berkeley National Laboratory referenced in the background of the present application. The testing included a frame constructed of fiberglass material, the corner keys being constructed of ABS, and using NovaGard 900-200 Corner Key Adhesive which yielded a U-factor of 0.22. An R5 insulation rating can be achieved if a fixed unit has a U-factor of 0.20 or less and an R5 rating is a sought after level of thermal insulation for a window. An R5 rating is achieved for an operating window unit where the U-factor is 0.22 or less. Various embodiments of the frame assemblies disclosed herein achieve an R5 rating. Windows constructed according to the present invention yield a DP value of at least 50 pounds per square foot (psf), a DP of at least 70 psf, and a DP of 90 psf in various embodiments of the present invention. Accordingly, frame assemblies constructed according to the present invention provide advantageous thermal and structural performance.

There are many possible embodiments of methods of forming a frame assembly in accordance with the present invention. In one embodiment, stock members such as the lineal members, the caps and/or frame assemblies are formed using pultrusion or extrusion so that each member has a uniform cross section over its length. In one embodiment, the members are formed by pultrusion of fiberglass. That is, fairly long stock frame members and frame member components can be formed by extrusion or pultrusion. Such stock members can be formed in a standard length, such as sixteen foot lengths, or can be formed in the specific lengths that are needed for making desired frame assemblies.

In some embodiments, each frame member has a uniform cross section along its length. The cavities that are defined within the frame member, regardless of the number of cavities, will also have uniform cross sections across their lengths. Each frame member includes a first end and a second end. The first and second ends can be orthogonal or angled relative to the longitudinal axis of the frame member to form a desired angle with abutting structure and/or frame members.

Each of the embodiments described above discloses a frame assembly system that can provide a high level of thermal insulation by virtue of the one, two, three, four, or more enclosed longitudinal cavities defined within each frame member. The enclosed cavities hinder thermal exchange through the opposite sides of the resultant frame assembly. The proposed frame assembly includes one or more corner keys which are positioned adjacent to an outer perimeter of the respective frame members or a resultant assembled frame. In some embodiments, the configuration and/or construction of the frame members permits insertion or introduction of the corner keys without any milling or removal of any material from an interior of the respective frame member to improve the efficiency with which individual frame assemblies can be formed.

In more than one of the disclosed embodiments, the corner key cavity extends across at least about 60% of a depth of the respective joined frame members. In some embodiments, the frame assembly system includes a cavity for a corner key that is defined between a lineal member and a cap. In other embodiments, the corner key cavity is formed by the cross-sectional shape of the frame member. The corner key cavity is preferably located at or adjacent to an outer perimeter of the assembled frame. The outer perimeter positioning of the corner key improves the strength and design pressure of the assembled frame thereby allowing the frame to withstand greater racking and/or compressive forces so as to provide a robust structural connection between adjacent frame members.

It is further appreciated that each of the embodiments disclosed above describe frame assemblies that are conducive to post assembly processing. That is, it is appreciated that the frame members and frame member components can be painted or laminated after formation of the desired frame shape or assembly. The paint coating or lamination covering can provide increased durability and aesthetic changes to the frame members so as to satisfy a litany of consumer demands or expectations aside from the shape of the frame assembly. It is further appreciated that alternate stock cap members can be provided for cooperation with the various frame members to still further expand the product offering platform.

To construct a particular frame assembly from stock frame members, the stock frame members are first cut to the appropriate length with an appropriate miter cut at the alternate ends of the frame member to be used. The cut frame member can then be subject to optional routing operations such as forming adhesive injection holes, forming venting holes, forming window valance knock-outs and other routing operations as appropriate for the type of window or intended use of the cut frame member. Hardware may also be added to the frame member if appropriate for formation of the desired frame assembly.

Once the necessary frame members have been prepared, the frame members are brought together preferably with a clamping system and with a desired corner key positioned at each corner or intersection of two frame members. It is appreciated that all of the frame members and all of the corners need not be the same lengths and/or angles, respectively. One leg or section of the corner key is inserted, into one end of a corner key cavity of a frame member and the other leg or section of the corner key is inserted into one end of a corner key cavity of the adjacent frame member. Adhesive is injected into the joint areas or those areas associated with the overlapping structures of the frame members, the lineal members, the caps, and/or the corner keys associated with forming the frame assembly. It is appreciated that the adhesive can be introduced at any time during the assembly process but is preferably completed after the respective components of a corner assembly have been positioned relative to one another. In one embodiment, each joint area can include one or more injection holes. Preferably, two such injection holes are provided in each frame member and are preferably located near each of the legs of the corner key, on opposite sides of the corner key, and close to the joint of the corner key to allow the adhesive to fully occupy the vacancies or voids between the structures of the joint. Preferably, each corner includes one or more vent holes that are also in close to the joint of the corner key to allow visual inspection of full propagation of the adhesive through the corner joint during the assembly process.

In one embodiment, adhesive used at the joints enhances the structural integrity of the completed frame. In some embodiments, separate mechanical fasteners are used at the joints, either alone or in addition to adhesive. In one embodiment, the joint is secured with adhesive without the use of any separate mechanical fasteners such as screws or tabs and bosses. When the frame members are formed of hollow profile material as in the preferred embodiments, the ends of the lineals are sometimes mitered. In addition to or instead of adhesive and fasteners, the mitered ends can be joined securely together by other methods, for example, by sonic welding.

In some embodiments, vinyl frame members are used in combination with ultrasonic bonding of the frame members to form a corner joint. However, it may be desirable to touch-up the appearance of the vinyl if the vinyl laminate is modified by the ultrasonic welding. The use of corner keys and adhesive to form the joint reduces the likelihood of requiring such a touch-up step. Understandably, it is appreciated that a frame assembly can be formed wherein some of the corner assemblies are formed with corner keys and other corners, such as those less visible, are formed by ultrasonic welding.

Various embodiments are described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims. An example of a system and method for forming a frame assembly has been described, but those of skill in the art will be aware of many options and alternatives to the equipment and steps described that can be used.

What is claimed is:

1. A method of forming a frame assembly comprising:

(a) providing a plurality of frame members, each frame member defining an interior space divided into at least three longitudinal cavities, wherein the at least three longitudinal cavities comprise first and second inner longitudinal cavities and an outer longitudinal corner key cavity, wherein the first and second inner longitudinal cavities are located adjacent each other in a transverse direction relative to the longitudinal cavities, and wherein the outer corner key cavity at least partially overlaps both the first and second inner longitudinal cavities in the transverse direction;

(b) providing at least one corner key, wherein each corner key has a first section and a second section, wherein each section of each corner key is configured to fit into one end of one of the outer corner key cavities; and (c) engaging the corner key with adjacent ones of the plurality of frame members;

(d) wherein when the plurality of frame members are engaged together using one or more of the corner keys, the plurality of frame members define an outer boundary and an inner boundary, wherein the inner boundary defines an opening, wherein the outer corner key cavity is adjacent to the outer boundary and the first and second inner longitudinal cavities are located inwardly relative to the outer corner key cavity toward the inner boundary.

2. The method of claim 1 comprising the step of providing four frame members and four corner keys, wherein the frame members and the corner keys are configured so that when the frame members are connected to each other using the corner keys, the frame members form an enclosed rectangular opening and define 90 degree angles relative to adjacent frame members.

3. The method of claim 1 wherein each frame member has a 45 degree angle cut on both ends and the first section of the corner key forms a 90 degree angle with the second section of the corner key.

4. The method of claim 1 wherein each of the frame members is a unitary structure and is formed of one of vinyl, fiberglass, an extrudate, and aluminum.

5. The method of claim 1 wherein each frame member includes a first end portion and a second end portion that are angled relative to a longitudinal axis of the frame member.

6. The method of claim 1 wherein each frame member has a depth extending from a first face to a second face, wherein the corner key cavity extends across a majority of the depth of the frame member.

7. The method of claim 1 wherein each frame member defines at least four longitudinal cavities.

8. A method of forming a frame assembly comprising:

(a) providing a plurality of frame members, each frame member comprising a lineal member defining a plurality of transversely adjacent inner cavities and an outer area that defines at least a portion of an outer corner key cavity, wherein each frame member has a depth, and wherein the outer corner key cavity overlaps at least two of the transversely adjacent inner cavities and extends across a majority of the depth of the lineal member;

(b) providing at least one corner key; and (c) joining adjacent ones of the frame members together using a corner key, wherein each corner key has a first section and a second section, and wherein each section of each corner key is configured to fit into the outer corner key cavity of adjacent lineal members, wherein the corner key is located adjacent an outer edge defined by the frame member and wherein, when the plurality of frame members are joined together using one or more of the corner keys positioned in the outer corner key cavities of adjacent lineal members, the plurality of lineal members define an outer boundary and an inner boundary, wherein the inner boundary defines an opening, wherein the corner key and the outer corner key cavity are adjacent to the outer boundary and the first and second inner longitudinal cavities are located inwardly relative to the corner key and the outer corner key cavity toward the inner boundary.

9. The method of claim 8 comprising providing four frame members and forming the four frame members into a frame assembly system using four corner keys, wherein the four frame members extend in orthogonal directions relative to adjacent frame members and define an outer perimeter and an inner perimeter, wherein the corner key cavity of each frame member is adjacent to the outer perimeter of the frame assembly system.

10. The method of claim 8 wherein the corner key cavity extends across less than the entire depth of the lineal member.

11. The method of claim 8 wherein each frame member has an angle cut on an end and the first section and second section of the corner key are oriented at an angle relative to one another that is the sum of the angles associated with the angle cut on ends of adjacent frame members.

12. The method of claim 8 wherein each frame member is formed of a material selected from the group consisting of fiberglass, vinyl, an extrudate, and aluminum.

13. The method of claim 8 wherein each frame member has a depth extending from a first face to a second face, and the corner key cavity extends across at least about 70% of the depth of the frame member.

* * * * *

UNITED STATES PATENT AND TRADEMARK OFFICE

CERTIFICATE OF CORRECTION

PATENT NO. : 8,683,694 B1
APPLICATION NO. : 14/061955
DATED : April 1, 2014
INVENTOR(S) : Emanuel et al.

It is certified that error appears in the above-identified patent and that said Letters Patent is hereby corrected as shown below:

Title Page, Item (75) Inventor is corrected to read:
-- Brian A. Emanuel, Baraboo, WI (US);
Gerald Beranek, Lone Rock, WI (US); --.

Signed and Sealed this
Twelfth Day of May, 2015

Michelle K. Lee

Michelle K. Lee
*Director of the United States Patent and Trademark Office*